US007237542B2

(12) United States Patent
Reisser

(10) Patent No.: US 7,237,542 B2
(45) Date of Patent: Jul. 3, 2007

(54) INTERNAL COMBUSTION ENGINE

(76) Inventor: Heinz-Gustav A. Reisser, 44494 S.R. 541, Coshocton, OH (US) 43812-0655

( * ) Notice: Subject to any disclaimer, the term of this patent is extended or adjusted under 35 U.S.C. 154(b) by 8 days.

(21) Appl. No.: 11/189,755

(22) Filed: Jul. 27, 2005

(65) Prior Publication Data

US 2007/0022983 A1 Feb. 1, 2007

(51) Int. Cl.
*F02B 75/18* (2006.01)

(52) U.S. Cl. ..... 123/665; 123/52.2; 123/52.4

(58) Field of Classification Search ..... 123/52.2, 123/52.4, 665
See application file for complete search history.

(56) References Cited

U.S. PATENT DOCUMENTS 1,428,858 A * 9/1922 Porter ..... 123/41.74
2,167,946 A * 8/1939 Gray ..... 123/51 B
2,264,648 A * 12/1941 Tebaldi ..... 123/52.4
2,303,025 A * 11/1942 Cliff ..... 123/51 AA
6,082,313 A * 7/2000 Leijonberg ..... 123/52.2
6,230,671 B1 * 5/2001 Achterberg ..... 123/48 R

FOREIGN PATENT DOCUMENTS

DE 3305852 A1 * 8/1984

* cited by examiner

*Primary Examiner*—Stephen K. Cronin
*Assistant Examiner*—Jason Benton
(74) *Attorney, Agent, or Firm*—Paul Vincent

(57) ABSTRACT

The invention concerns a combustion engine comprising a cylinder and a piston which is displaceably guided in the cylinder, the piston having a piston head facing a combustion chamber and being coupled to a crankshaft via a connecting rod, wherein a second piston which is displaceably guided in the cylinder is provided opposite to the piston, the second piston also having a piston head, wherein the combustion chamber is disposed between the two piston heads, and the second piston is coupled to a crankshaft via a connecting rod.

10 Claims, 2 Drawing Sheets

INTERNAL COMBUSTION ENGINE

BACKGROUND OF THE INVENTION

The invention concerns an internal-combustion engine with a cylinder and a piston which is displaceably guided in the cylinder, the piston having a piston head facing a combustion chamber and coupled to a crankshaft via a connecting rod.

Engines of this type have been known for more than a hundred years and are used as stationary drives as well as for vehicles. The cylinder in these combustion engines is closed on one side with a cylinder head and, on the other side, a piston is moveably guided in the cylinder to transfer the driving force to a crankshaft via a connecting rod as the combustion gases expand. Combustion engines operating according to this principle may function in two cycles or four cycles, such as Otto and diesel engines. The efficiency of these engines is, however, very low.

It is the underlying purpose of the invention to provide a combustion engine having higher efficiency.

SUMMARY OF THE INVENTION

This object is achieved in accordance with the invention with a combustion engine of the above-mentioned type by providing a second opposing piston, wherein the second piston is displaceably guided in the cylinder and also has a piston head, the combustion chamber being disposed between the two piston heads with the second piston being coupled to a crankshaft via a connecting rod.

In contrast to conventional combustion engines, the inventive combustion engine does not have a cylinder head, rather a further piston, wherein part of the cylinder and the piston heads of the two pistons define the combustion chamber. When the combustion gas is ignited in this combustion chamber, the two pistons are driven in opposite directions, i.e. forced apart, and transmit their motion to the crankshafts via their connecting rods. The gases expanding in the combustion chamber thereby drive not only one but two pistons to substantially increase the efficiency. Moreover, the combustion engine in accordance with the invention has reduced fuel consumption, improved emission values, and is easier to service.

Advantageously, the pistons move simultaneously during expansion of the combustion gases, i.e. the forces and moments generated are largely compensated for. Vibrations are thereby almost completely compensated for, such that special devices such as e.g. balancer shafts etc. are not required.

In a preferred embodiment, the two pistons are disposed at an angle of 180° relative to each other. This means that the two pistons are disposed opposite to each and exercise opposite motions. For this reason, the cylinder may be a simple sleeve.

Alternatively, the two pistons may be disposed at an angle relative to each other which is different from 180°, i.e. the cylinder may have a V-shape. This reduces the size of the engine.

In a particularly preferred embodiment, the upper dead centers of the two pistons have a separation from each other, and the cylinder wall in this region between the pistons may comprise an inlet valve, an outlet valve, a fuel injector and optionally a spark or glow plug. The pistons may also have recesses in the jacket region, which are especially provided for this purpose to prevent them from passing over the cylinder wall in the region of the valves or ignition devices.

In a preferred manner, the combustion chamber is spherical. This is advantageous in that the expansion forces of the combustion gases expand uniformly in all directions thereby uniformly introducing the forces into the pistons.

The piston head is preferably recessed and forms part of the combustion chamber. The depression may thereby be partially spherical, have a different shape, or comprise means for swirling the combustion gases.

50% to 90%, in particular 75% of the combustion chamber is located in the piston head of the two pistons. The rest of the combustion chamber is formed by the region of the cylinder located between the two pistons. If the combustion chamber is spherical, the region of the cylinder located between the two pistons has a partially spherical curvature when the pistons are in the upper dead center. The combustion chamber which is formed by this part of the cylinder and the two piston heads then has a spherical, i.e. ball-shaped design.

The inventive combustion engine may be a two-cycle or four-cycle engine, wherein the Otto principle as well as the diesel principle may be used. In the variant of a two-cycle engine, the piston passes over the overflow channels. Inlet and outlet valves are not provided.

In accordance with the invention, the two crankshafts are coupled to a flywheel e.g. via transmission wheels and rotate in the same direction. The crankshafts may also be coupled to the flywheel using chains or toothed belts.

Further advantages, features and details of the invention can be extracted from the dependent claims and the following description which describes in detail a particularly preferred embodiment with reference to the drawing. The features shown in the drawing and mentioned in the claims and in the description may be essential to the invention either individually or in arbitrary combination.

DESCRIPTION OF THE PREFERRED EMBODIMENT

Figure 1:
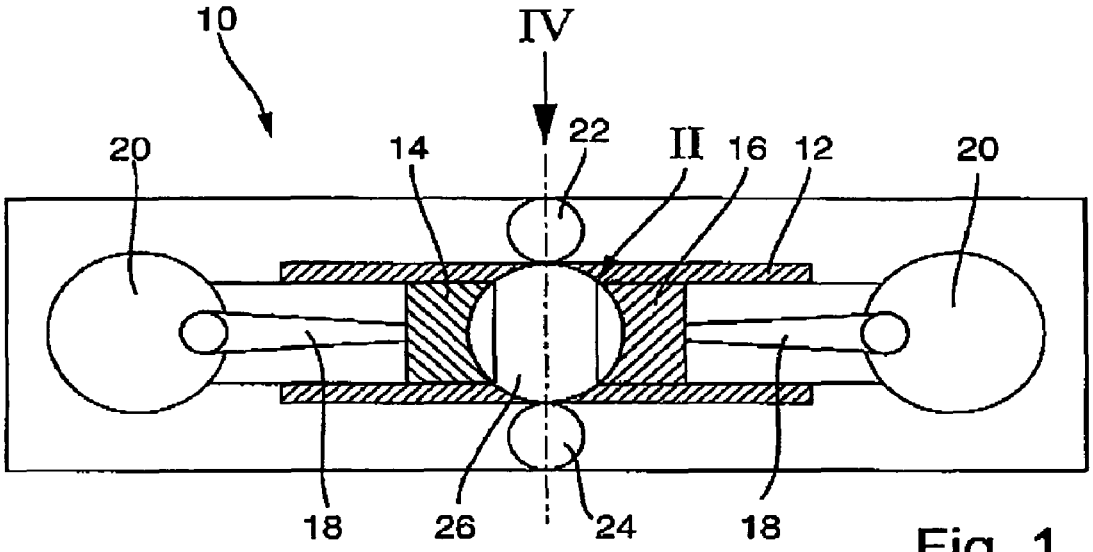
FIG. 1 shows a section I—I in accordance with FIG. 4 through a preferred embodiment of the inventive combustion engine.
Figure 4:
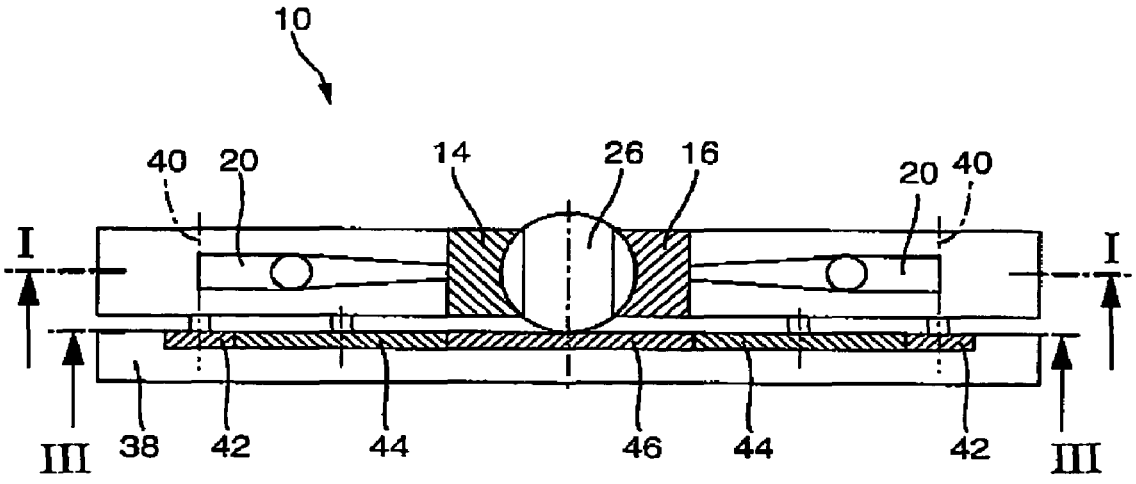
FIG. 4 shows a top view of the combustion engine of FIG. 1, viewed in the direction of arrow IV.

FIG. 1 shows a side view of a section I—I in accordance with FIG. 4 of the combustion engine which is designated in total with 10. This section shows the combustion engine 10 in a highly schematic manner. Many components are schematically indicated, such as e.g. the cylinder 12 which has substantially the shape of a sleeve and accommodates two pistons 14 and 16 which are disposed to be displaceable and movable in opposite directions. These pistons 14 and 16 are each mounted to a connecting rod 18 which is connected to a crankshaft, designated in total with 20. The drives 22 and 24 for the inlet valve and the outlet valve are also shown. These drives 22 and 24 are formed e.g. by camshafts. FIG. 1 also shows that the combustion chamber 26 has a spherical shape.

Figure 2:
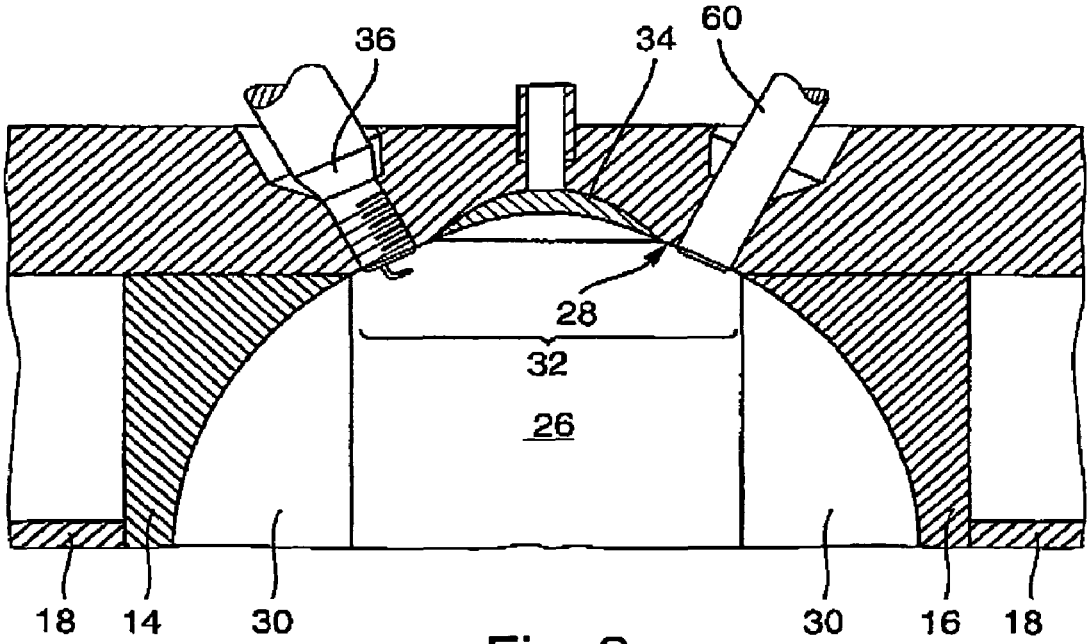
FIG. 2 shows an enlarged view of the region II in accordance with FIG. 1.

FIG. 2 shows an enlarged view of the spherical combustion chamber 26 with the two pistons 14 and 16 being located at their upper dead center position. It is clearly shown that the spherical shape provided in the wall 28 of the cylinder 12 is continued in the piston heads 30 of the two pistons 14 and 16 in that the piston heads 30 are recessed. The partially spherical region 32 of the wall 28 of the cylinder 12 has one of the two valves, e.g. the inlet valve 34, which is also curved in a partially spherical shape. The partially spherical curvature of the region 32 of the cylinder wall 28 is continued in the piston head 30 such that the entire combustion chamber 36 is substantially spherical. Finally, an injector nozzle 60 and a spark plug 36 are indicated in FIG. 2. The spark plug 36 could alternatively represent a glow plug, should the combustion engine 10 be operated according to the diesel principle.

Figure 3:
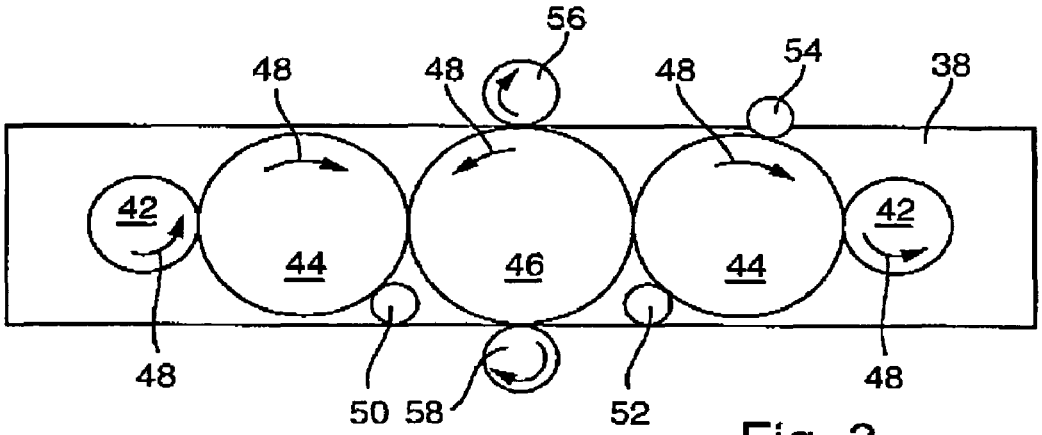
FIG. 3 shows a section III—III in accordance with FIG. 4 through the gearbox of the engine.

FIG. 3 shows a gearbox designated with 38 into which the axes 30 of the crankshafts 20 terminate, each carrying a toothed crank wheel 42. This toothed crank wheel 42 mates with a transmission or transfer toothed wheel 44 which engages a flywheel 46. The directions of rotation of the toothed wheels 42, 44 and 46 are indicated by arrows 48.

FIG. 3 also shows a toothed wheel 50 for driving an oil pump (not shown), a toothed wheel 52 for a water pump (not shown), and a toothed wheel 54 for a starter (not shown), which all engage the transmission toothed wheels 44. Driving toothed wheels 56 and 58 for the valve camshaft drives 22 and 24 engage the flywheel 46.

The forces and moments generated are clearly largely symmetrical due to the symmetric arrangement of the individual components, thereby largely eliminating imbalances and vibrations.

The inventive combustion engine 10 has a higher efficiency, since the forces generated in the combustion chamber 26 simultaneously act on not only one, but two pistons 14 and 16, which both drive the flywheel 46.

I claim:

1. A combustion engine, the engine comprising:

a cylinder, said cylinder having a concave annular recess in an axially central portion thereof;

a first piston displaceably guided in said cylinder, said first piston having a concave first piston bottom;

a first crankshaft;

a first connecting rod connected between said first piston and said first crankshaft;

a second piston disposed opposite to said first piston and displaceably guided in said cylinder, said second piston having a concave second piston bottom, wherein said first and said second piston bottoms face and define, together with said cylinder, a combustion chamber within said cylinder;

a second crankshaft; and a second connecting rod connected between said second piston and said second crankshaft, wherein at upper dead center positions of said first piston and of said second piston, said first piston bottom, said second piston bottom, and said concave annular recess define a spherical combustion chamber.

2. The combustion engine of claim 1, wherein said first and said second pistons move in opposite directions.

3. The combustion engine of claim 1, wherein said first and said second pistons move simultaneously.

4. The combustion engine of claim 1, wherein said first and said second pistons are disposed at an angle of 180° relative to each other.

5. The combustion engine of claim 1, wherein said first and said second pistons are separated from each other at upper dead center positions thereof, wherein an inlet valve, an outlet valve, an injection nozzle and/or a spark or glow plug are provided in a cylinder wall region between said first and said second piston bottoms.

6. The combustion engine of claim 1, wherein 50% to 90% of said combustion chamber is located in said first and said second piston bottoms.

7. The combustion engine of claim 6, wherein 75% of said combustion chamber is located in said first and said second piston bottoms.

8. The combustion engine of claim 1, wherein the engine is a two-cycle, a four-cycle, an Otto or a diesel engine.

9. The combustion engine of claim 1, wherein said first and said second crankshafts are coupled to a flywheel.

10. The combustion engine of claim 9, wherein said first and said second crankshafts rotate in a same direction.

* * * * *